US008089418B2

(12) United States Patent
Gardner et al.

(10) Patent No.: US 8,089,418 B2
(45) Date of Patent: Jan. 3, 2012

(54) ANTENNA STRUCTURE

(75) Inventors: Donald S. Gardner, Mountain View, CA (US); Seong-Youp Suh, San Jose, CA (US)

(73) Assignee: Intel Corporation, Santa Clara, CA (US)

( * ) Notice: Subject to any disclaimer, the term of this patent is extended or adjusted under 35 U.S.C. 154(b) by 408 days.

(21) Appl. No.: 12/237,524

(22) Filed: Dec. 4, 2008

(65) Prior Publication Data

US 2010/0141533 A1 Jun. 10, 2010

(51) Int. Cl.
*H01Q 9/28* (2006.01)

(52) U.S. Cl. ..... 343/795; 343/700 MS

(58) Field of Classification Search ..... 343/795, 343/700 MS, 702
See application file for complete search history.

(56) References Cited

U.S. PATENT DOCUMENTS

| | | | | |
|---|---|---|---|---|
| 6,992,632 | B1 * | 1/2006 | Mohuchy | 343/700 MS |
| 2006/0076405 | A1 * | 4/2006 | Takimoto | 235/382 |
| 2009/0085182 | A1 * | 4/2009 | Yamazaki et al. | 257/679 |
| 2009/0160719 | A1 * | 6/2009 | Kato et al. | 343/742 |

OTHER PUBLICATIONS

Yang, G.M. et al. "Planar circular loop antennas with self-biased magnetic film loading", Electronic Letters, Feb. 28, 2008—vol. 44 No. 5.

Bae, S. et al. "Effect of Ni-Zn ferrite on bandwidth and radiation efficiency of embedded antenna for mobile phone", Journal of Applied Physics 103, 07E929 (2008), Published online Mar. 13, 2008.

Mosallaei, Hossein et al. "Antenna Miniturization and Bandwidth Enhancement Using a Reactive Impendance Substrate", IEEE Transactions on Antennas and Propagation, vol. 52, No. 9, Sep. 2004.

* cited by examiner

*Primary Examiner* — Hoanganh Le
(74) *Attorney, Agent, or Firm* — Cool Patent, P.C.; Kenneth J. Cool

(57) ABSTRACT

An antenna structure that includes a magnetic film coated on a textured backside of an antenna substrate to reduce the size of antenna from an average size of the antenna for a predetermined frequency band.

23 Claims, 5 Drawing Sheets

ANTENNA STRUCTURE

BACKGROUND OF THE INVENTION

In modern wireless communications, there is a growing need for small-size, low-cost antennas for a wide range of portable and handheld devices. Currently, most antennas for mobile devices are fabricated by patterning copper traces on a substrate or stamped metal. These substrates are large and costly to fabricate. Another problem with regard to the size of the antenna may be for example, antennas for an Ultra High Frequency (UHF) spectrum (e.g., 470 MHz to 860 MHz) which are longer in size (e.g., a dipole antenna for 680 MHz is 20 cm in length by 1.5 cm wide) and that may be used for small size mobile devices such as, for example, laptop computers, handheld devices and the like.

Magnetic meta-materials have been explored for use as antenna substrates, but they are complex and expensive to manufacture. A study that used ferrite to increase the bandwidth of the antenna had as a side effect, a 7.5% reduction in the resonant frequency as compared to an air-core antenna. Another study obtained a mere 1.2% reduction in the resonant frequency. It is compelling to have small antennas in a space limited mobile device

BRIEF DESCRIPTION OF THE DRAWINGS

The subject matter regarded as the invention is particularly pointed out and distinctly claimed in the concluding portion of the specification. The invention, however, both as to organization and method of operation, together with objects, features and advantages thereof, may best be understood by reference to the following detailed description when read with the accompanied drawings in which:

Figure 1:
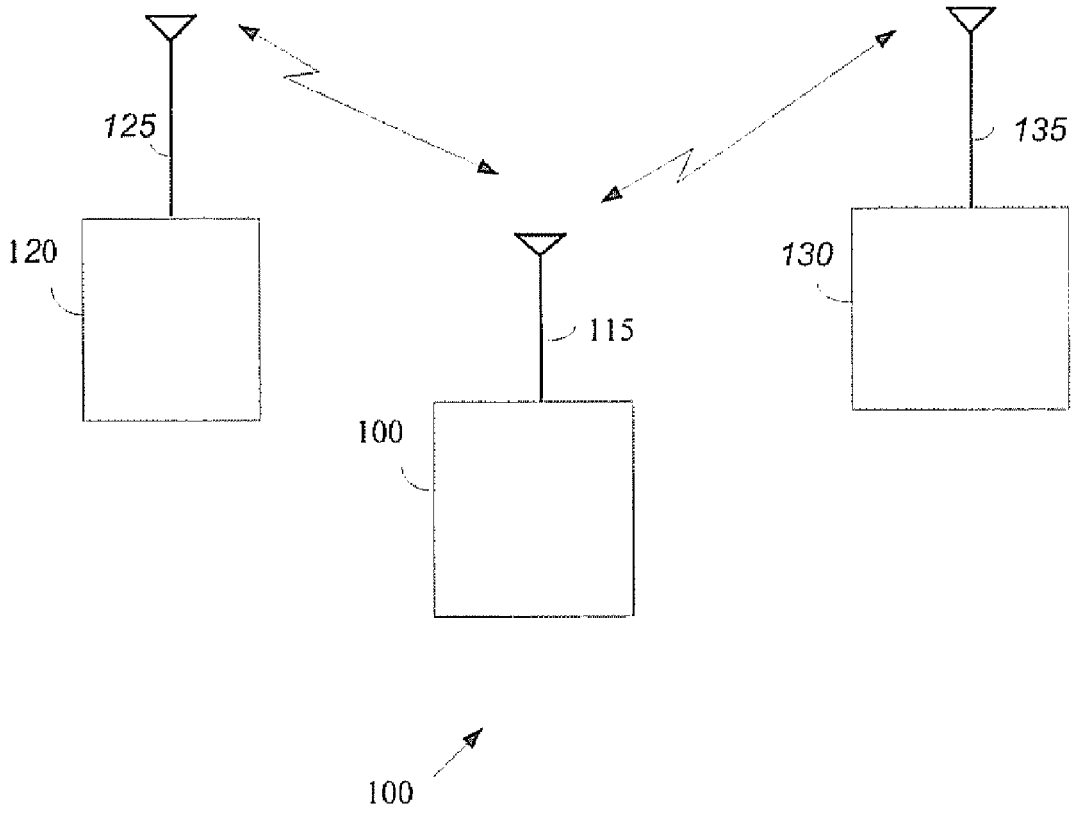
FIG. 1 is an illustration of a portion of communication system according to an exemplary embodiment of the present invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE INVENTION

In the following detailed description, numerous specific details are set forth in order to provide a thorough understanding of the invention. However it will be understood by those of ordinary skill in the art that the present invention may be practiced without these specific details. In other instances, well-known methods, procedures, components and circuits have not been described in detail so as not to obscure the present invention.

According to embodiments of the invention antenna substrates with increased permeability that may lead to antenna miniaturization, enhanced bandwidth, and improved radiation and polarization characteristics are presented. For example, the antenna structures may use a magnetic material that includes depositing magnetic material such as, for example amorphous CoZrTa. The amorphous CoZrTa may be applied for example, to a backside of a textured antenna substrate of a dipole antenna which may miniaturize the dipole antenna and/or improve the dipole antenna bandwidth.

Turning to FIG. 1, a wireless communication system 100, in accordance with exemplary embodiment of the invention is shown. Although the scope of the present invention is not limited in this respect, wireless communication system 100 may include wireless metropolitan area network (WMAN) according to IEEE standard 802.16 family, a wireless local area network (WLAN) according to IEEE standard 802.11 family, a cellular system, a wireless telephone system, a two way radio system and the like.

According to some exemplary embodiments of the invention, wireless communication system may include a base station 110 and mobile stations 120 and 130. Base station 110 may include an at least one antenna 115, mobile station 120 may include an at least one antenna 125 and mobile station 130 may include an at least one antenna 135, although it should be understood that this example wireless communication system is not limited in this respect.

According to this exemplary embodiment, mobile stations 120 and 130 may include a mobile handheld device, a laptop computer, a netbook computer, a mobile telephone device, a mobile game console and the like.

Although the scope of the present invention is not limited in this respect, at least one of antennas 115, 125 and 135 may include a dipole antenna with a magnetic film coated on a textured backside of the dipole antenna. The magnetic film may include Cobalt (Co), Zirconium (Zr), Tantalum (Ta) alloy, although it should be understood that other magnetic film alloy with other elements which provide similar properties may be used with embodiment of the invention.

Figure 2:
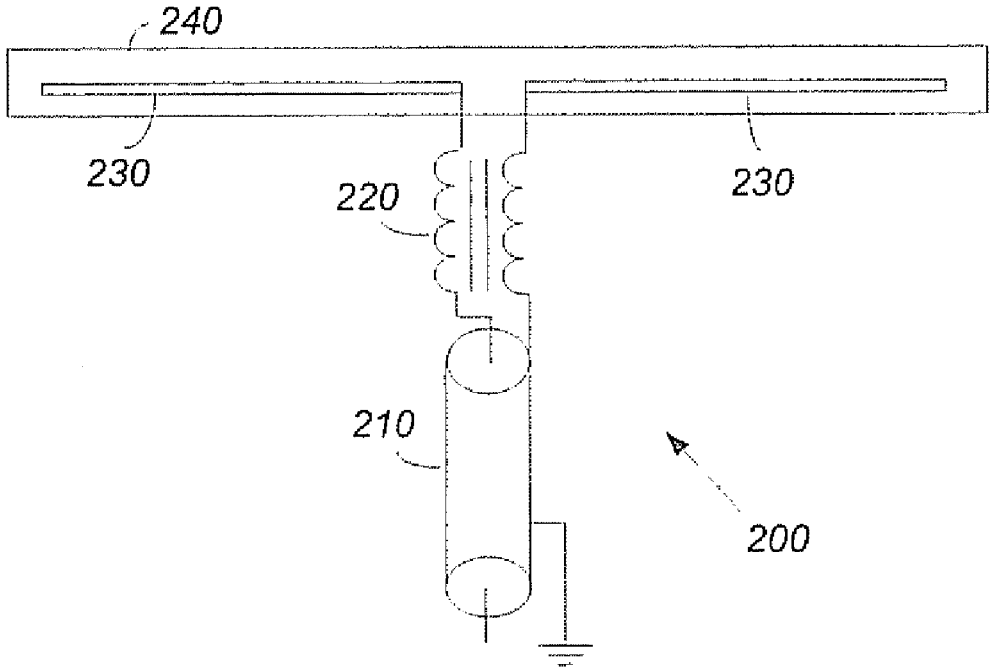
FIG. 2 is an illustration of a dipole antenna according to some exemplary embodiments of the invention.

Turning to FIG. 2 an illustration of a dipole antenna structure according to some exemplary embodiments of the invention is shown. According to this exemplary embodiment a dipole antenna 200 may include a feeder line 210, a balun 220, antenna substrates 230 and a magnetic film alloy 240. Feeder line 210 may have an impedance of 50 ohms and may be a coax cable and/or coaxial connector, if desired. An example of balun 220 may be ferrite core and/or coaxial cable and/or a metal and/or ferrite pipe with the coax cable place inside the pipe, if desired. Antenna substrates 230 of embodiments of the invention may be textured on their backside, if desired. Magnetic film alloy 240 may be coated on the backside of antenna substrates 230, although it should be understood that embodiment of the invention are in no way limited to this example.

Figure 3:
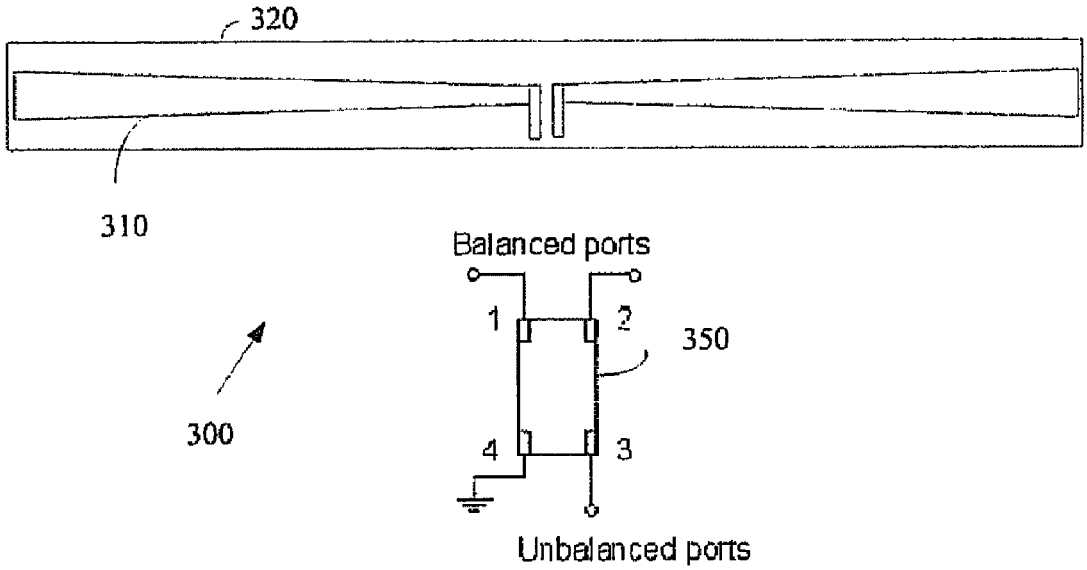
FIG. 3 is an illustration of an antenna structure according to exemplary embodiment of the invention.

Turning to FIG. 3 an illustration of an antenna structure according to exemplary embodiment of the invention is shown. According to this exemplary embodiment a structure of a dipole antenna 300 is shown. Dipole antenna 300 may include antenna radiators 310, an antenna substrate 320 and an electrical connection scheme 350, although it should be understood that the scope of the present invention is not limited to this exemplary embodiment.

Figure 4:
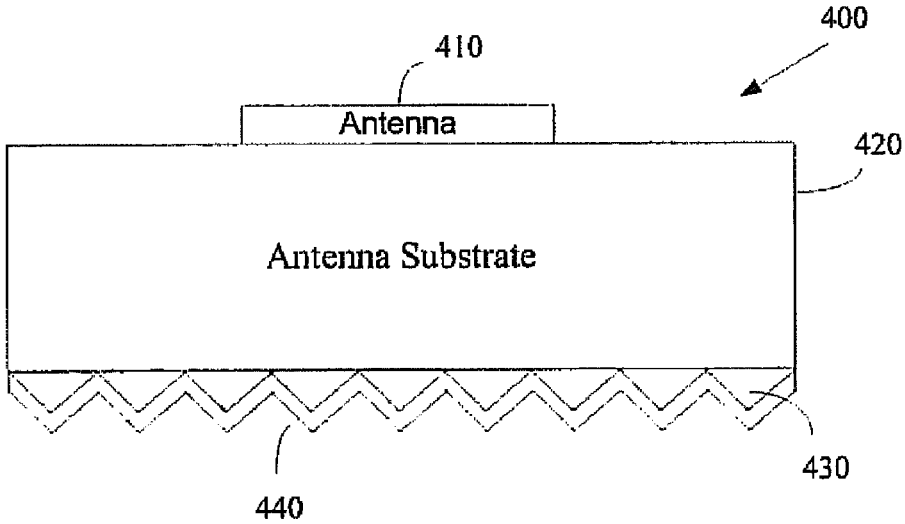
FIG. 4 is an illustration of a cross section of antenna structure of FIG. 3 according to some exemplary embodiments of the invention.

Turning to FIG. 4, an illustration of a cross section of an antenna structure according to an exemplary embodiment of the invention is shown. According to this exemplary embodiment, a dipole antenna 400 may include antenna radiators 410, a textured surface 430 of antenna substrate 420 and a magnetic film alloy 440. For example, a magnetic material layer of magnetic film alloy 440 may include an alloy selected from the group consisting of CoZrTa, CoZr, CoZrNb (wherein, Nb is a chemical symbol of Niobium), CoZrMo (wherein, Mo is a chemical symbol of Molybdenum), FeCo AlN (wherein, Fe is a chemical symbol of Ferrum and AlN is a chemical symbol of Aluminium nitride), NiFe (wherein, Ni is a chemical symbol of Nickel), CoP (wherein, P is a chemical symbol of Phosphorus), CoPW (wherein, W is a chemical symbol of Tungsten), CoPBW (wherein, B is a chemical symbol of Boron), CoPRe (wherein, Re is a chemical symbol of Rhenium), CoPFeRe, CoFeHfO (wherein, Hf is a chemical symbol of Hafnium and O is a chemical symbol of Oxygen), FeCoP, FeTaN (wherein, N is a chemical symbol of Nitrogen), FeCoBSi (wherein, Si is a chemical symbol of Silicon), and any combination thereof may be used. Furthermore, in some other embodiments of the invention the magnetic material of magnetic film alloy 440 may be alternate between a magnetic material from the list above and a dielectric such as, for example Silicon dioxide ($SiO_2$), Silicon Nitrogen (SiN), Aluminum Oxide (AlO), Silicon Oxide Nitrogen (SiON), cobalt oxide, polyimide and/or other dielectrics, although the scope of the present invention is not limited in this respect.

According to exemplary embodiments of the invention, magnetic film 440 is coated on the textured backside of antenna substrate 420. This texturing may create isotropic magnetic properties and may change the effective permeability of magnetic film 440. The resulting size of the exemplary dipole antenna 400 may be less than half the length of the air-core antenna, although the scope of the present invention is not limited in this respect.

In another embodiment of the invention, magnetic film alloy 440 may be used on textured antenna substrates of a folded dipole antenna. It should be understood that magnetic film alloy 440 may be used with many different antenna structures in order to reduce the size of the antennas. Furthermore, the properties of the magnetic film alloy 440 are designed to reduce an average size of antenna for use in a predetermined frequency band by at least 10% of the average size of the antenna for the predetermined frequency band.

According to an embodiment of the invention, in order to reduce the size of antennas, there is a need to design the material and the structure of magnetic film alloy 440 by optimizing properties for the magnetic material to minimize losses from eddy currents and from the skin depth effect in combination with an optimal surface texture and thickness for the antenna substrate. The CoZrTa alloy with the receptivity of 100 micro-ohm cm, the eddy currents at 600 Mhz may be controller by keeping the thickness at less then 1 micrometer and the surface texture may be more than 1 micrometer. In this embodiment, the magnetic film thickness may be less than the surface roughness (rms or root-mean-square roughness). For example, for a 0.5 um thick CoZrTa film, the surface roughness would be greater than 0.5 um thick, if desired.

Alternatively, incorporating a multilayered film consisting of dielectric and magnetic materials that may match the impedance between the substrate and the magnetic material so as to reduce reflections and improve efficiency. According to embodiments of the invention, magnetic materials may be used to reduce the size of the antenna. For example, amorphous CoZrTa alloy that balances the magnetic properties with the antenna structure may be used.

Figure 5:
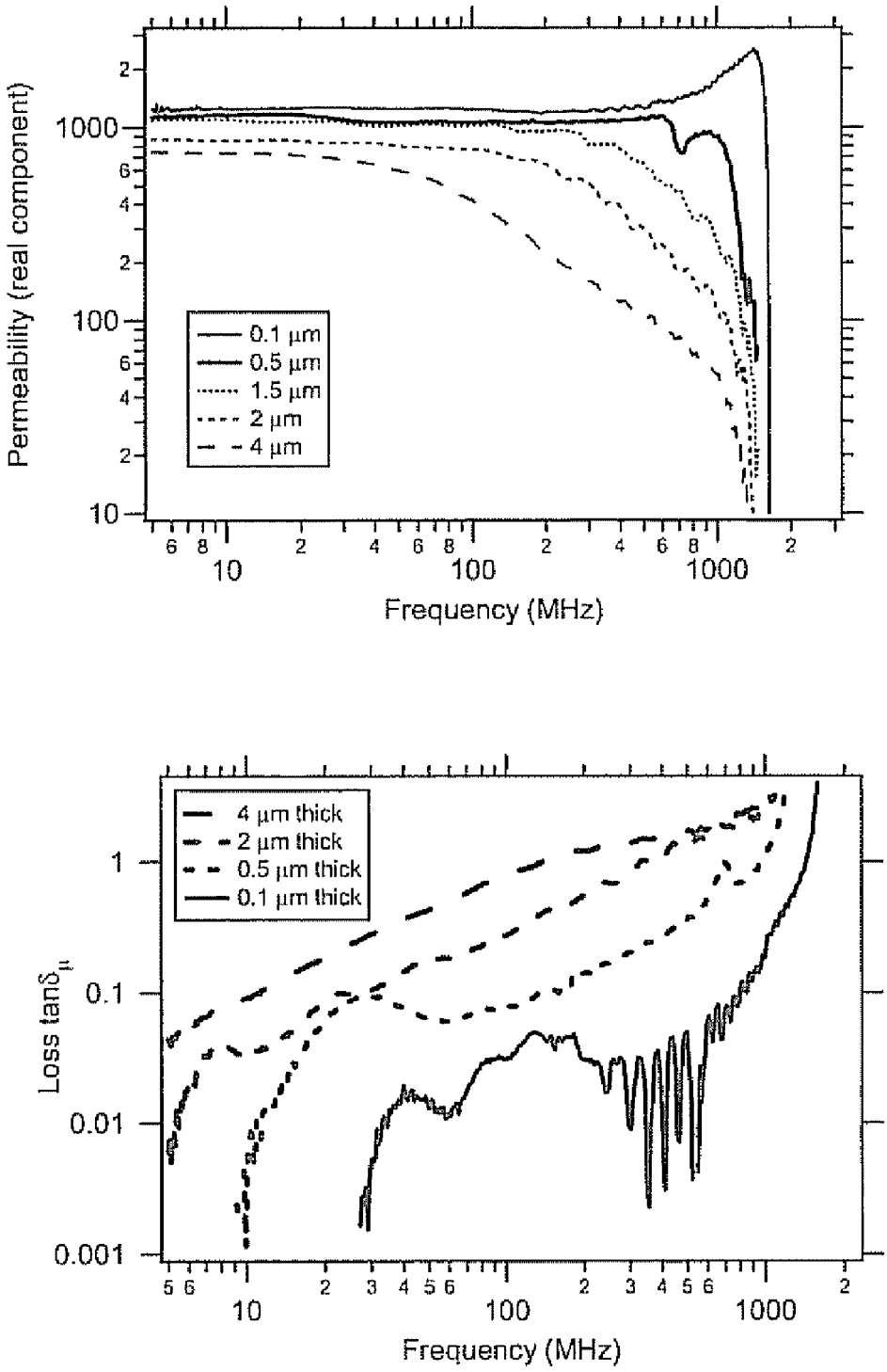
FIG. 5 is a graphic presentation of permeability versus frequency measurements on a magnetic film according to embodiments of the invention.

Turning to FIG. 5, a graphic presentation of measurements of the permeability versus frequency and the loss tan $\delta_\mu$ of a CoZrTa magnetic film alloy according to embodiments of the invention is shown. The measurements show the effects of the magnetic film properties on the performance of the magnetic film antenna. According to the measurements, it may be observed that as the thickness of the magnetic material increases, the loss tan $\delta_\mu$ increases because of increasing eddy currents and skin depth effects.

Texturing of the antenna substrate is designed to alter the magnetic properties. For example, texturing of the antenna substrate may be 1 to 2 micrometer. High quality amorphous soft magnetic films may be deposited by physical vapor deposition with low cost and at room temperature, which leads to easy integration into an antenna fabrication process, although the scope of the present invention is not limited in this respect.

According to embodiments of the invention, the CoZrTa alloy may obtain a good combination of high permeability, high saturation magnetization, low magnetostriction and high resistivity. For example, the CoZrTa alloy may obtain a combination permeability, $\mu_r$, greater then 25, saturation magnetization greater than 0.5 Tesla, less then 1 parts per million (ppm) magnetostriction and greater 25 micro-ohm cm resistivity, if desired. For example, Cobalt (Co) may be prepared by incorporating Zr to create an amorphous film and Ta to minimize magnetostriction, to 0.2 ppm, if desired. This may leads to excellent magnetic softness with coercivity less than 0.02 Oe, high $4\pi M_s$ wherein $M_s$ depicted a saturation magnetization, a high ferromagnetic resonance (FMR) frequency of 1.4 GHz, and a low magnetostriction coefficient of less than 0.2 ppm (significantly better than the coefficient of 60 ppm for pure cobalt).

Figure 6:
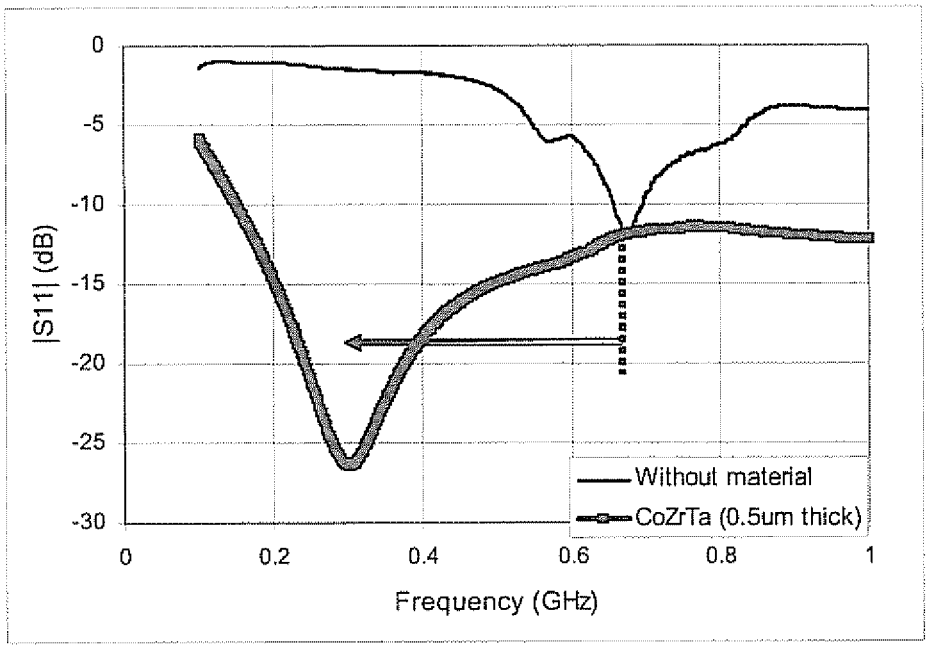
FIG. 6 is a graphic presentation of a return loss versus frequency measurements on a dipole antenna according to embodiments of the invention.

Turning to FIG. 6 a graphic presentation of return loss versus frequency measurements on a dipole antenna 200 according to embodiments of the invention is shown. According to the measurements, it is shown that the resonant frequency of the dipole antenna may be shifted by greater than 50% using CoZrTa magnetic films. According to these measurements, by using the CoZrTa magnetic films, the size of antennas for the UHF band (470 MHz to 860 MHz) may be reduced for example, from 200 millimeters in length to 100 millimeter in length.

Figure 7:
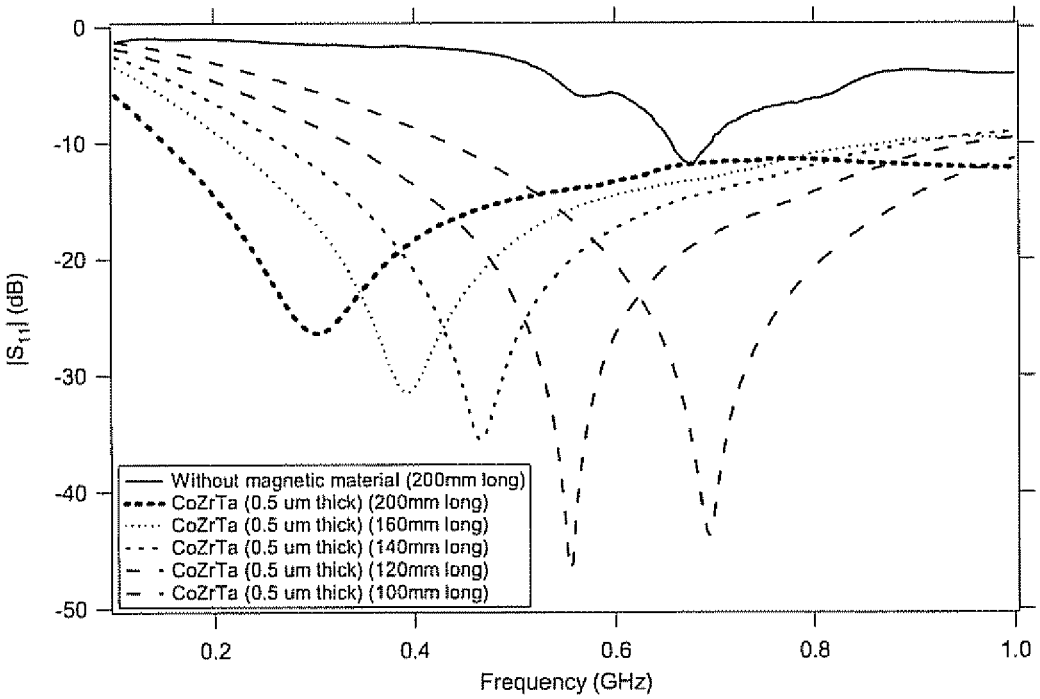
FIG. 7 is a graphic presentation of measurements on different dipole antennas with different lengths according to embodiments of the invention.

Turning to FIG. 7, a graphic presentation of measurements on different dipole antennas with different lengths according to embodiments of the invention is shown. For example, measured return loss of an antenna with different antenna lengths using amorphous CoZrTa material on the textured backside of the antenna substrates. Results shown in FIG. 7 demonstrate that a change in the resonant frequency may be obtained with different antenna lengths that use magnetic material and that a similar resonant frequency may be obtained with an antenna with less than half the size. Further improvements may be made by more closely matching the input impedance to the impedance of air by optimizing the thickness, relative permeability $\mu_r$ and dielectric constant $\in_r$ and the substrate texture. The dielectric constant $\in_r$ may be increased by adding alternating layers of magnetic and dielectric material so as to make the ratio of $\mu_r/\in_r$ closer to unity and may reduce eddy currents.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. An antenna comprising:

a magnetic film coated on a backside of an antenna substrate to reduce the size of the antenna from an average size of the antenna for a predetermined frequency band;

wherein the magnetic film has a permeability $\mu_r$ greater then 25, saturation magnetization greater than 0.5 Tesla, magnetostriction less than 1 parts per million (ppm) and resistivity greater than 100 micro-ohm cm.

2. The antenna of claim 1, wherein the magnetic film comprises a Cobalt (Co), Zirconium (Zr), Tantalum (Ta) alloy.

3. The antenna of claim 1 comprises a dipole antenna.

4. The antenna of claim 1, wherein a thickness of the magnetic film alloy is adjusted according to a magnetic film surface roughness.

5. The antenna of claim 1 comprises a folded dipole antenna.

6. The antenna of claim 1 wherein the backside of the antenna substrate is textured.

7. The antenna of claim 1, wherein the magnetic film comprises a magnetic material layer comprising an alloy selected from a group consisting of CoZrTa, CoZr, CoZrNb, CoZrMo, FeCoAlN, NiFe, CoP, CoPW, CoPBW, CoPRe, CoPFeRe, CoFeHfO, FeCoP, FeTaN, FeCoBSi, and a combination thereof and wherein, Co is a chemical symbol of Cobalt;
Zr is a chemical symbol of Zirconium;
Ta is a chemical symbol of Tantalum;
Nb is a chemical symbol of Niobium;
Mo is a chemical symbol of Molybdenum
Fe is a chemical symbol of Ferrum;
AlN is a chemical symbol of Aluminum nitride;
Ni is a chemical symbol of Nickel;
P is a chemical symbol of Phosphorus;
W is a chemical symbol of Tungsten;
B is a chemical symbol of Boron;
Re is a chemical symbol of Rhenium;
Hf is a chemical symbol of Hafnium;
N is a chemical symbol of Nitrogen;
Si is a chemical symbol of Silicon; and
O is a chemical symbol of Oxygen.

8. The antenna of claim 1, wherein the magnetic film comprises a magnetic material layer comprising a dielectric.

9. A wireless communication device comprising:

an antenna having a magnetic film coated on a backside of an antenna substrate to reduce the size of the antenna from an average size of the antenna for a predetermined frequency band;

wherein the magnetic film has a permeability $\mu_r$ greater then 25, saturation magnetization greater than 0.5 Tesla, magnetostriction less than 1 parts per million (ppm) and resistivity greater than 100 micro-ohm cm.

10. The wireless communication device of claim 9, wherein the magnetic film comprises a Cobalt (Co), Zirconium (Zr), Tantalum (Ta) alloy.

11. The wireless communication device of claim 9, wherein the antenna comprises a dipole antenna.

12. The wireless communication device of claim 9, wherein a thickness of the magnetic film alloy is adjusted according to a magnetic film surface roughness.

13. The wireless communicating device of claim 9 comprises a notebook computer.

14. The wireless communication device of claim 9 comprises a handheld device.

15. The wireless communication device of claim 9 wherein the antenna comprises a folded dipole antenna.

16. The wireless communication device of claim 9, wherein the backside of the antenna substrate is textured.

17. The wireless communication device of claim 10, wherein the magnetic film comprises a magnetic material layer comprising an alloy selected from a group consisting of CoZrTa, CoZr, CoZrNb, CoZrMo, FeCoAlN, NiFe, CoP, CoPW, CoPBW, CoPRe, CoPFeRe, CoFeHfO, FeCoP, FeTaN, FeCoBSi, and a combination thereof and wherein, Co is a chemical symbol of Cobalt;
Zr is a chemical symbol of Zirconium;
Ta is a chemical symbol of Tantalum;
Nb is a chemical symbol of Niobium;
Mo is a chemical symbol of Molybdenum
Fe is a chemical symbol of Ferrum;
AlN is a chemical symbol of Aluminum nitride;
Ni is a chemical symbol of Nickel;
P is a chemical symbol of Phosphorus;
W is a chemical symbol of Tungsten;
B is a chemical symbol of Boron;
Re is a chemical symbol of Rhenium;
Hf is a chemical symbol of Hafnium;
N is a chemical symbol of Nitrogen;
Si is a chemical symbol of Silicon; and
O is a chemical symbol of Oxygen.

18. The wireless communication device of claim 9, wherein the magnetic film comprises a magnetic material layer comprising a dielectric.

19. A method for reducing a size of antenna comprising:

coating a magnetic film on a backside of an antenna substrate to reduce the size of the antenna from an average size of the antenna for a predetermined frequency band;

wherein the magnetic film has a permeability $\mu_r$ greater than 25, saturation magnetization greater than 0.5 Tesla, magnetostriction less than 1 parts per million (ppm) and resistivity greater than 100 micro-ohm cm.

20. The method of claim 19, comprising:

providing the magnetic film which includes a Cobalt (Co), Zirconium (Zr), Tantalum (Ta) alloy.

21. The method of claim 19 comprising reducing a size of a dipole antenna to half size of an average size of the dipole antenna for a predetermined frequency band.

22. The method of claim 19, comprising:

adjusting a thickness of the magnetic film alloy according to a magnetic film surface roughness.

23. The method of claim 19, comprising:

selecting an alloy for the magnetic film from a group consisting of CoZrTa, CoZr, CoZrNb, CoZrMo, FeCoAlN, NiFe, CoP, CoPW, CoPBW, CoPRe, CoPFeRe, CoFeHfO, FeCoP, FeTaN, FeCoBSi, and a combination thereof and wherein, Co is a chemical symbol of Cobalt;
Zr is a chemical symbol of Zirconium;
Ta is a chemical symbol of Tantalum;
Nb is a chemical symbol of Niobium;
Mo is a chemical symbol of Molybdenum
Fe is a chemical symbol of Ferrum;
AlN is a chemical symbol of Aluminum nitride;
Ni is a chemical symbol of Nickel;
P is a chemical symbol of Phosphorus;
W is a chemical symbol of Tungsten;
B is a chemical symbol of Boron;
Re is a chemical symbol of Rhenium;
Hf is a chemical symbol of Hafnium;
N is a chemical symbol of Nitrogen;
Si is a chemical symbol of Silicon; and
O is a chemical symbol of Oxygen.

* * * * *

UNITED STATES PATENT AND TRADEMARK OFFICE

CERTIFICATE OF CORRECTION

PATENT NO. : 8,089,418 B2
APPLICATION NO. : 12/237524
DATED : January 3, 2012
INVENTOR(S) : Donald S. Gardner et al.

It is certified that error appears in the above-identified patent and that said Letters Patent is hereby corrected as shown below:

On the cover page, in item (56), in column 2, under "Other Publications", line 8, delete "Miniturization" and insert -- Miniaturization --, therefor.

On the cover page, in item (56), in column 2, under "Other Publications", line 9, delete "Impendance" and insert -- Impedance --, therefor.

In column 5, line 7, in claim 1, delete "then" and insert -- than --, therefor.

In column 5, line 30, in claim 7, delete "Molybdenum" and insert -- Molybdenum; --, therefor.

In column 5, line 49, in claim 9, delete "then" and insert -- than --, therefor.

In column 5, line 59, in claim 13, delete "communicating" and insert -- communication --, therefor.

In column 6, line 3, in claim 17, delete "claim 10," and insert -- claim 9, --, therefor.

In column 6, line 12, in claim 17, delete "Molybdenum" and insert -- Molybdenum; --, therefor.

In column 6, line 52, in claim 23, delete "Molybdenum" and insert -- Molybdenum; --, therefor.

Signed and Sealed this
Third Day of April, 2012

David J. Kappos

David J. Kappos
*Director of the United States Patent and Trademark Office*